US008791636B2

(12) United States Patent
Mori

(10) Patent No.: US 8,791,636 B2
(45) Date of Patent: Jul. 29, 2014

(54) FLASHTUBE AND STROBE APPARATUS

(75) Inventor: Tadao Mori, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/881,180

(22) PCT Filed: Dec. 1, 2011

(86) PCT No.: PCT/JP2011/006729
§ 371 (c)(1),
(2), (4) Date: Apr. 24, 2013

(87) PCT Pub. No.: WO2012/073515
PCT Pub. Date: Jun. 7, 2012

(65) Prior Publication Data

US 2013/0214678 A1 Aug. 22, 2013

(30) Foreign Application Priority Data

Dec. 2, 2010 (JP) ..... 2010-268990

(51) Int. Cl.
*H01J 17/16* (2012.01)
*H01J 61/30* (2006.01)
*H01J 61/36* (2006.01)
*H01J 61/80* (2006.01)

(52) U.S. Cl.
CPC ..... *H01J 61/80* (2013.01); *H01J 61/363* (2013.01); *H01J 61/302* (2013.01)
USPC ..... 313/634; 313/632

(58) Field of Classification Search
CPC ..... H01J 61/90; H01J 61/80; H01J 2893/007; H01J 61/302; H01J 61/045; H05B 41/30; H01S 3/092; F21K 5/023; G03B 15/03
USPC ..... 313/632; 396/155, 176
See application file for complete search history.

(56) References Cited

U.S. PATENT DOCUMENTS

| | | | | |
|---|---|---|---|---|
| 4,315,187 | A * | 2/1982 | Chow | 313/558 |
| 5,025,192 | A * | 6/1991 | Okamoto | 313/623 |
| 5,182,237 | A | 1/1993 | Brix | |
| 6,554,452 | B1 * | 4/2003 | Bourn et al. | 362/247 |
| 2005/0168149 | A1 * | 8/2005 | Hiramoto et al. | 313/636 |

FOREIGN PATENT DOCUMENTS

| | | | |
|---|---|---|---|
| JP | 7-89743 | A | 4/1995 |
| JP | 8-124521 | A | 5/1996 |
| JP | 2006-244896 | A | 9/2006 |
| JP | 2009-170327 | A | 7/2009 |
| JP | 2010-232126 | A | 10/2010 |

OTHER PUBLICATIONS

International Search Report for PCT/JP2011/006729, Dec. 27, 2011.

* cited by examiner

*Primary Examiner* — Donald Raleigh
(74) *Attorney, Agent, or Firm* — RatnerPrestia

(57) ABSTRACT

A flashtube of the present invention includes a glass tube, an anode-side electrode disposed at one end of the glass tube, and a cathode-side electrode disposed at the other end of the glass tube. The glass tube includes a first glass tube, and second glass tubes coupled to respective ends of the first glass tube via stage joint glass tubes. Each of the stage joint glass tube has a thermal expansion coefficient between the thermal expansion coefficient of the first glass tube and that of each of the second glass tube. A ratio of the outer diameter of the anode-side electrode to the inner diameter of the glass tube is 43.5% or higher.

5 Claims, 2 Drawing Sheets

FIG. 2

| A | B | | |
|---|---|---|---|
| Inner diameter of glass tube | Outer diameter of anode-side electrode | Durability result | B/A |
| 2.65 | 1.0 | X | 37.7% |
| 2.1 | 0.8 | X | 38.1% |
| 2.3 | 1.0 | O | 43.5% |
| 2.65 | 1.5 | O | 56.6% |
| 2.3 | 1.5 | O | 65.2% |
| 2.1 | 1.5 | O | 71.4% |

FLASHTUBE AND STROBE APPARATUS

TECHNICAL FIELD

The present invention relates to a flashtube and a strobe apparatus including the flashtube.

BACKGROUND ART

Recent electronic equipment such as a digital camera or a mobile phone having a camera function includes a strobe apparatus having a rod-like flashtube, for example.

The flashtube of the strobe apparatus essentially includes the following elements:

- a glass tube;
- an anode electrode as an anode-side electrode disposed at one end of the glass tube; and
- a cathode electrode as a cathode-side electrode disposed at the other end of the glass tube (for example, Patent Literature 1).

Generally, the glass tube of the flashtube is made of borosilicate glass, and the anode electrode and cathode electrode are made of tungsten in consideration of durability against thermal shock in light emission, for example.

Digitization of picked up data has enabled failed picked-up data (e.g. photograph) to be erased, so that the number of photographs taken with electronic equipment including a strobe apparatus has recently increased significantly. The number of light emissions by the strobe apparatus also has increased significantly. Therefore, the strobe apparatus is required to have higher durability for light emission (emission durability) than ever.

When a crack appears in the glass tube of the flashtube due to stress during flash light emission, however, rare gas filled in the flashtube leaks or the strength of the glass tube of the flashtube reduces, thereby reducing the durability of the strobe apparatus. Therefore, it is required to increase the strength of the glass tube of the flashtube.

It is conventionally known that, in order to increase the strength of the glass tube of the flashtube, the glass tube is made of quartz glass. Generally, quartz glass is mainly made of silicon dioxide, and has a characteristic where the melting point is about 2000° C. and the thermal expansion coefficient is about $0.55\times10^{-6}$/° C. The quartz glass is resistant to thermal shock occurring during light emission of the flashtube, and has high transmission in the light wavelength region from ultraviolet to infrared. The quartz glass having high strength and high transmission is in widespread use for a glass tube of a flashtube.

Tungsten used in the anode electrode and cathode electrode of a flashtube has a melting point of about 3400° C. and a thermal expansion coefficient of about $4.5\times10^{6}$/° C., and hence has sufficient durability against thermal shock.

However, the melting point and thermal expansion coefficient of quartz glass are significantly different from those of tungsten. When the anode electrode and cathode electrode are directly bonded to the glass tube by heating and melting the glass tube, a crack appears in the glass tube or electrode sealing section due to difference in melting point and thermal expansion coefficient, disadvantageously.

In order to address this problem, the following method is used:

- a bead section that is formed of several kinds of glasses and has a thermal expansion coefficient between the thermal expansion coefficient of quartz glass and that of tungsten is welded and fixed to the glass tube; and
- the tungsten used as the anode electrode and cathode electrode is fixed to the glass tube via the bead section fixed to the glass tube.

As another method, borosilicate glass is coupled to quartz glass via stage joint glass formed of several kinds of glasses having different thermal expansion coefficients, for example, thereby increasing the strength of the glass tube of the flashtube. In other words, the stage joint glass absorbs the difference in thermal expansion coefficient between the quartz glass and the tungsten used as the anode electrode and cathode electrode.

When the strength of the glass tube is increased, the durability of the glass tube is increased. However, the durability of the anode electrode and cathode electrode is the same as ever and hence the durability of the whole flashtube does not vary. Therefore, for example, the influence of discharge on the cathode electrode is reduced using a sintered metal body. In this case, the anode electrode is made of tungsten as it is, so that the durability of the anode electrode is lower than that of the glass tube. As a result, the emission durability of the flashtube is low.

Thus, it is required to consider the influence of the emission durability on the flashtube, especially on the anode electrode.

In other words, it is desired that the emission durability of the flashtube is increased by increasing the strength of the glass tube and the durability of the anode-side electrode.

CITATION LIST

Patent Literature

PTL 1 Unexamined Japanese Patent Publication No. 2006-244896

SUMMARY OF THE INVENTION

A flashtube of the present invention includes the following elements:

- a glass tube;
- an anode-side electrode disposed at one end of the glass tube; and
- a cathode-side electrode disposed at the other end of the glass tube.

The glass tube includes a first glass tube, and second glass tubes coupled to respective ends of the first glass tube via stage joint glass tubes. Each of the stage joint glass tubes have a thermal expansion coefficient between the thermal expansion coefficient of the first glass tube and that of each of the second glass tubes. A ratio of the outer diameter of the anode-side electrode to the inner diameter of the glass tube is 43.5% or higher.

Thus, a flashtube can be achieved where the strength of the glass tube is increased and the emission durability of the flashtube is increased comparing with the case where the glass tube is formed of only one kind of glass tube.

BRIEF DESCRIPTION OF DRAWINGS

FIG. 2 is a diagram showing a result of an emission durability test of the flashtube in accordance with the exemplary embodiment of the present invention.

DESCRIPTION OF EMBODIMENTS

Figure 1:
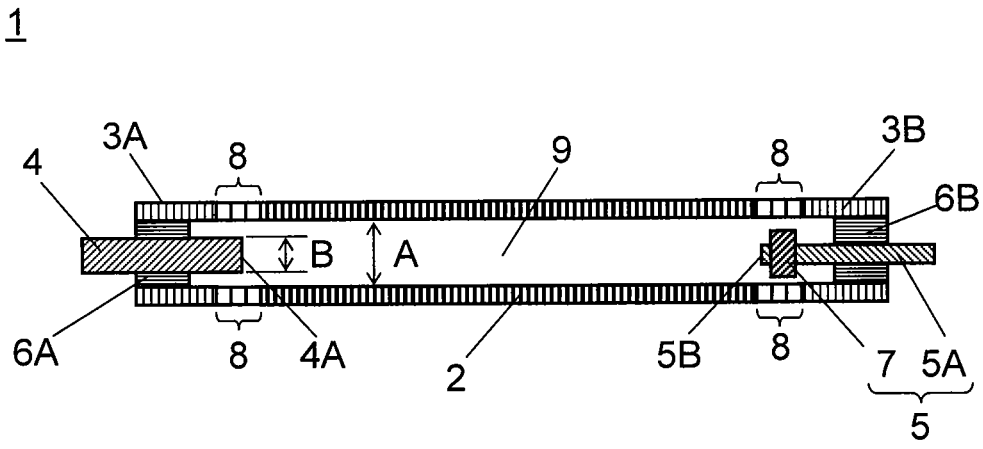
FIG. 1 is a sectional view of a flashtube in accordance with an exemplary embodiment of the present invention.

A flashtube of an exemplary embodiment of the present invention will be described hereinafter with reference to the accompanying drawings.

FIG. 1 is a sectional view of the flashtube in accordance with the exemplary embodiment of the present invention.

As shown in FIG. 1, flashtube 1 of the exemplary embodiment is formed in a long-size shape (rod like), for example, and includes the following elements:

a glass tube;

anode electrode 4 as an anode-side electrode disposed at one end of the glass tube; and cathode electrode 5 as a cathode-side electrode disposed at the other end of the glass tube.

The glass tube includes the following elements:

long-size first glass tube 2 having a low thermal expansion coefficient, for example; and second glass tubes 3A and 3B that are shorter than first glass tube 2 and have a thermal expansion coefficient higher than that of first glass tube 2, for example.

First glass tube 2 is coupled to second glass tubes 3A and 3B via stage joint glass tubes 8. At this time, stage joint glass tubes 8 have a thermal expansion coefficient between the thermal expansion coefficient of first glass tube 2 and that of second glass tubes 3A and 3B. First glass tube 2 is thus coupled to second glass tubes 3A and 3B while the difference between the thermal expansion coefficient of first glass tube 2 and that of second glass tubes 3A and 3B is alleviated.

As shown in FIG. 1, in the present exemplary embodiment, anode electrode 4 is disposed on the side of one second glass tube 3A, and cathode electrode 5 is disposed on the side of the other second glass tube 3B. Anode electrode 4 and cathode electrode 5 are welded to second glass tubes 3A and 3B via bead sections 6A and 6B, respectively.

First glass tube 2 is formed of a glass tube made of quartz glass or the like. Second glass tubes 3A and 3B are formed of glass tubes made of glass material such as borosilicate glass that has a thermal expansion coefficient substantially the same (or the same) as those of anode electrode 4, cathode electrode 5, and bead sections 6A and 6B.

Anode electrode 4 is formed of a metal rod made of tungsten or the like, fixed to one bead section 6A, and fixed to second glass tube 3A via bead section 6A. Tip 4A of anode electrode 4 on the first glass tube 2 side is projected through bead section 6A toward cathode electrode 5 as the cathode-side electrode. In FIG. 1, preferably, the ratio (100×B/A) of outer diameter B of anode electrode 4 to inner diameter A of the glass tube is kept to be 43.5% or higher and lower than 100%, as described in detail.

Cathode electrode 5 includes cathode body 5A and sintered metal body 7 supported by cathode body 5A. At this time, cathode body 5A is formed of a metal rod made of tungsten or the like, is fixed to other bead section 6B, and is fixed to second glass tube 3B via bead section 6B. Tip 5B of cathode electrode 5 on the first glass tube 2 side is projected toward anode electrode 4 as the anode-side electrode through bead section 6B and sintered metal body 7.

Each of bead sections 6A and 6B has a through hole at its center position, for example. Anode electrode 4 and cathode electrode 5 pass through the through holes of bead sections 6A and 6B, respectively. The outer diameters of bead sections 6A and 6B are slightly shorter than the inner diameter of the glass tube (e.g. second glass tubes 3A and 3B). By welding and fixing bead sections 6A and 6B, both ends of the glass tube of flashtube 1 are sealed via bead sections 6A and 6B, anode electrode 4, and cathode electrode 5. Here, bead sections 6A and 6B have an expansion coefficient that is the same as those of anode electrode 4, cathode electrode 5, and second glass tubes 3A and 3B.

Sintered metal body 7 of cathode electrode 5 is supported coaxially with cathode body 5A at tip 5B of cathode body 5A on the first glass tube 2 side. Sintered metal body 7 is configured to emit a great number of electrons when voltage is applied between anode electrode 4 and cathode electrode 5. Sintered metal body 7 is formed by molding, into a predetermined shape, a mixture of metal micro powder made of tungsten and tantalum and a mixture of metal micro powder made of tantalum and nickel, and by sintering the molded produce at a temperature of about 1500° C.

Each stage joint glass tube 8 is formed of a plurality of layers of glass tubes, for example, that are sequentially welded to each other so that the melting points and thermal expansion coefficients of stage joint glass tubes 8 vary in stages between those of first glass tube 2 and those of second glass tubes 3A and 3B. Specifically, a part of stage joint glass tube 8 on the side of each of second glass tubes 3A and 3B has a thermal expansion coefficient lower than that of each of second glass tubes 3A and 3B. A part of stage joint glass tube 8 on the side of first glass tube 2 has a thermal expansion coefficient higher than that of first glass tube 2. In other words, each stage joint glass tube 8 is formed of the plurality of layers of glass tubes (in the present exemplary embodiment, three layers) having different thermal expansion coefficients that vary in stages.

As shown in FIG. 1, at least one of tip 4A of anode electrode 4 and tip 5B of cathode electrode 5 is disposed in a position from stage joint glass tube 8 to first glass tube 2. In other words, the durability of flashtube 1 is improved by disposing anode electrode 4 and/or tip 5B of cathode electrode 5 in the position from stage joint glass tube 8, which is resistant to thermal shock during discharge, to first glass tube 2. Especially, preferably, anode electrode 4 and/or tip 5B of cathode electrode 5 is disposed inside first glass tube 2. However, they may be disposed optionally in response to a necessary characteristic.

Thus, the inside of flashtube 1 is sealed by thermally welding the glass tube that includes first glass tube 2, stage joint glass tubes 8, and second glass tubes 3A and 3B to bead sections 6A and 6B that support and fix anode electrode 4 and cathode electrode 5. At this time, flashtube 1 is filled with rare gas 9 such as xenon or the like as discharge gas at a predetermined pressure and sealed.

As discussed above, in flashtube 1 of the present exemplary embodiment, first glass tube 2 and each of second glass tubes 3A and 3B that have different melting points and thermal expansion coefficients are inter-coupled via stage joint glass tube 8 formed of the plurality of layers of glass tubes so that the melting point and thermal expansion coefficient vary in stages. At this time, a part of stage joint glass tube 8 on the side connected to first glass tube 2 has a melting point and thermal expansion coefficient substantially the same extent (including the same) as those of first glass tube 2. A part of stage joint glass tube 8 on the side connected to each of second glass tubes 3A and 3B has a melting point and thermal expansion coefficient substantially the same extent (including the same) as those of each of second glass tubes 3A and 3B. The melting point and thermal expansion coefficient of stage joint glass tube 8 that is formed of the plurality of layers of glass tubes vary in stages from those of first glass tube 2 to those of each of second glass tubes 3A and 3B.

Since first glass tube 2 and each of second glass tubes 3A and 3B that have different melting points and thermal expansion coefficients are inter-coupled via stage joint glass tube 8 configured as above, they are integrated into the glass tube without causing a crack. First glass tube 2, second glass tubes 3A and 3B, and stage joint glass tube 8 are formed and welded to each other so as to have the same outer diameter, thereby coaxially integrating first glass tube 2 and second glass tubes 3A and 3B.

In flashtube 1 of the present exemplary embodiment, anode electrode 4 and cathode electrode 5 are welded and fixed to second glass tubes 3A and 3B at the both ends of first glass tube 2 via bead sections 6A and 6B, respectively. Therefore, even when the first glass tube is made of quartz glass, anode electrode 4 and cathode electrode 5 can be made of tungsten having a thermal expansion coefficient completely different from that of the quartz glass.

In flashtube 1 of the present exemplary embodiment, first glass tube 2 is coupled to each of second glass tubes 3A and 3B via stage joint glass tube 8. Therefore, a plurality of glass tubes having different thermal expansion coefficients can be used. As a result, comparing with a conventional flashtube, the strength of the glass tube of flashtube 1 can be increased.

The emission durability of flashtube 1 of the present exemplary embodiment can be increased by setting the ratio of outer diameter B of anode electrode 4 to inner diameter A of the glass tube at a predetermined value (e.g. 43.5% or higher), as shown in the following example.

Example

An example is described in detail where the ratio (B/A) of outer diameter B of anode electrode 4 to inner diameter A of the glass tube is set so as to increase the emission durability of flashtube 1.

Regarding a digital camera including a strobe apparatus having flashtube 1, the number of light emissions of the strobe apparatus increases as the number of photographs increases. Light emission of the strobe apparatus causes a trace quantity of electrode material to sputter and scatter from the anode electrode, so that the light quantity of the strobe apparatus gradually decreases from the initial light quantity. That is because the scattering electrode material adheres to the inner wall of the glass tube or causes a crack in the glass tube, and hence disturbs light transmission. As a result, the emission durability of flashtube 1 decreases as the number of light emissions increases, for example.

In order to prevent the light quantity (emission durability) of the strobe apparatus from decreasing from the initial quantity, the emission durability of the strobe apparatus including flashtube 1 is studied under the following condition in consideration of the relationship between inner diameter A of the glass tube and outer diameter B of anode electrode 4.

The condition and result of an emission durability test of the strobe apparatus are hereinafter described with reference to FIG. 2.

First, as shown in FIG. 2, flashtube 1 where ratio B/A has a predetermined value of 37.7% to 71.4%, for example, is prepared by combining the glass tube having inner diameter A of 2.1 mm to 2.65 mm and anode electrode 4 having outer diameter B of 0.8 mm to 1.5 mm. At this time, a glass tube having a thickness of 0.225 mm or greater is employed.

Next, prepared flashtube 1 is connected to a circuit for inspection (not shown).

Next, the emission durability is investigated by applying input voltage of 330 V and input electric energy of 95.3 Ws to the circuit for inspection, and making flashtube 1 emit light over 30,000 times at an emission interval of 10 seconds.

The determination condition of the emission durability is set as follows:

"emission durability is high" when the light quantity of flashtube 1 after the test is 90% or higher of the initial light quantity of flashtube 1 before the test; and "emission durability is not high" when the light quantity after the test is less than 90% of the initial light quantity before the test.

FIG. 2 shows "O" when "emission durability is high", or "x" when "emission durability is not high".

As a result, as shown in FIG. 2, the emission durability of flashtube 1 satisfies the determination condition if ratio B/A (%) of outer diameter B of anode electrode 4 to inner diameter A of the glass tube is 43.5% or higher and less than 100%.

As discussed above, flashtube 1 having a sufficient emission durability can be achieved by configuring flashtube 1 so that the ratio of the outer diameter of anode electrode 4 to the inner diameter of the glass tube is 43.5% or higher and less than 100%.

In other words, flashtube 1 can be achieved where the light quantity is 90% or higher of the initial light quantity even after light is emitted over 30,000 times at an emission interval of 10 seconds under the above-mentioned condition.

In the present exemplary embodiment, a flashtube can be achieved where the strength of the glass tube is increased by adjusting the melting point and thermal expansion coefficient of the glass tube.

In the present exemplary embodiment, the emission durability of the flashtube can be increased by optimizing the ratio of outer diameter B of anode electrode 4 to inner diameter A of the glass tube.

As a result, a flashtube having high durability and a strobe apparatus having the flashtube can be achieved.

The present invention is not limited to the exemplary embodiment. The flashtube and the strobe apparatus may be modified as long as they do not go out of scope of the present invention.

In the present exemplary embodiment, first glass tube 2 is made of quartz glass having a low thermal expansion coefficient, and second glass tubes 3A and 3B are made of borosilicate glass having a high thermal expansion coefficient. However, the present invention is not limited to this. For example, an example may be employed where first glass tube 2 is formed of a glass tube having a high thermal expansion coefficient and second glass tubes 3A and 3B are formed of glass tubes having a low thermal expansion coefficient. Even in this case, the thermal expansion coefficient of the material of the anode electrode and cathode electrode is required to match with that of the second glass tubes. In other words, the glass tube of high strength is coupled to the glass tube having a thermal expansion coefficient substantially equal to that of the anode electrode and cathode electrode via the stage joint glass tube. Therefore, the thermal expansion coefficients of the second glass tubes, bead sections, anode electrode, and cathode electrode are required to be close to each other. Even in this case, the strength of the glass tube can be increased and the emission durability of flashtube 1 can be increased comparing with the case where the glass tube is formed of only a glass tube made of borosilicate glass.

In the present exemplary embodiment, stage joint glass tube 8 that couples first glass tube 2 to each of second glass tubes 3A and 3B is formed of three layers of stage joint glass whose thermal expansion coefficients are different from each other in stages. The present invention is not limited to this. For example, stage joint glass tube 8 may be formed of one layer, two layers, four layers, or more layers of glass. In other words, the number of layers and material of the stage joint glass tube may be altered appropriately in response to the molding purpose of the glass tube or temperature distribution in the glass tube. In other words, the stage joint glass tube may have any configuration as long as the strength of the glass tube is increased and the emission durability of flashtube 1 is increased.

In the present exemplary embodiment, the tip of anode electrode 4 and/or cathode electrode 5 is disposed in a position from stage joint glass tube 8 to first glass tube 2. The present invention is not limited to this. For example, when the strength of second glass tubes 3A and 3B is high, the tip of anode electrode 4 and/or cathode electrode 5 may be disposed on the side of second glass tube 3A and/or 3B (one end side and/or the other side of the glass tube) other than stage joint glass tube 8. In other words, the tip of anode electrode 4 and/or cathode electrode 5 may be disposed at any position as long as the strength of the glass tube is increased and the emission durability of flashtube 1 is increased.

In the present exemplary embodiment, sintered metal body 7 of the cathode electrode is supported coaxially with cathode body 5A at the tip of cathode body 5A on the first glass tube 2 side. The present invention is not limited to this. In other words, sintered metal body 7 does not need to be coaxial with cathode body 5A as long as sintered metal body 7 can emit a great number of electrons when voltage is applied between anode electrode 4 and cathode electrode 5.

The flashtube of the present invention includes the following elements:

a glass tube;

an anode-side electrode disposed at one end of the glass tube; and a cathode-side electrode disposed at the other end of the glass tube.

The glass tube includes a first glass tube, and second glass tubes coupled to respective ends of the first glass tube via stage joint glass tubes. The stage joint glass tubes have a thermal expansion coefficient between the thermal expansion coefficient of the first glass tube and that of the second glass tubes. The ratio of the outer diameter of the anode-side electrode to the inner diameter of the glass tube is 43.5% or higher.

Thus, the strength of the glass tube can be increased comparing with the case where the glass tube is formed of only one kind of glass tube, by inter-coupling a plurality of glass tubes having different thermal expansion coefficients via a stage joint glass tube having a thermal expansion coefficient between the different thermal expansion coefficients.

By setting the ratio (%) of the outer diameter of the anode-side electrode to the inner diameter of the glass tube at 43.5% or higher, reduction in light quantity of the flashtube can be alleviated and the emission durability of the flashtube can be increased.

In the present invention, the thermal expansion coefficient of the stage joint glass tube is varied in stages from the thermal expansion coefficient of the first glass tube to that of the second glass tubes, so that the difference between the thermal expansion coefficient of the first glass tube and that of the second glass tubes can be effectively alleviated.

In the present invention, the anode-side electrode and cathode-side electrode are fixed to the second glass tubes via the bead sections, respectively. Thus, the anode-side electrode and cathode-side electrode are further firmly fixed to the second glass tubes via the bead sections, so that appearance of a crack in the glass tube can be prevented and the strength of the glass tube can be increased.

In the present invention, the first glass tube is made of quartz glass and the second glass tubes are made of borosilicate glass. Thus, the reliability of the flashtube can be improved by employing, for the glass tube of the flashtube, the first glass tube made of quartz glass that is resistant to thermal shock and the second glass tubes made of borosilicate glass that easily seals the electrode made of tungsten.

In the present invention, the tip of at least one of the anode-side electrode and cathode-side electrode is disposed in a position from the stage joint glass tube to the first glass tube. Thus, the durability of the flashtube can be increased by using stage joint glass tube 8 and first glass tube 2 that are resistant to thermal shock during discharge.

The strobe apparatus of the present invention includes the flashtube. Thus, a strobe apparatus having high reliability and high emission durability can be achieved.

INDUSTRIAL APPLICABILITY

The flashtube of the present invention enables the strength of the glass tube and the emission durability to be increased. Therefore, the flashtube is useful for a strobe apparatus required to perform quite a few light emissions.

REFERENCE MARKS IN THE DRAWINGS

1 flashtube
2 first glass tube
3A, 3B second glass tube
4 anode electrode (anode-side electrode)
4A, 5B tip
5 cathode electrode (cathode-side electrode)
5A cathode body
6A, 6B bead section
7 sintered metal body
8 stage joint glass tube
9 rare gas

The invention claimed is:

1. A flashtube comprising:

a glass tube;

an anode-side electrode disposed at one end of the glass tube; and a cathode-side electrode disposed at the other end of the glass tube, the glass tube including:

a first glass tube; and second glass tubes coupled to respective ends of the first glass tube via stage joint glass tubes, a tip of at least one of the anode-side electrode and the cathode-side electrode is disposed in a position from the stage joint glass tube to the first glass tube, wherein each of the stage joint glass tubes has a thermal expansion coefficient between a thermal expansion coefficient of the first glass tube and a thermal expansion coefficient of each of the second glass tubes, and a ratio of an outer diameter of the anode-side electrode to an inner diameter of the glass tube is 43.5% or higher.

2. The flashtube of claim 1, wherein the thermal expansion coefficient of each stage joint glass tube is varied in stages from the thermal expansion coefficient of the first glass tube to the thermal expansion coefficient of each second glass tube.

3. The flashtube of claim 1, wherein the anode-side electrode and the cathode-side electrode are fixed to the second glass tubes via bead sections, respectively.

4. The flashtube of claim 1, wherein the first glass tube is made of quartz glass, and the second glass tubes are made of borosilicate glass.

5. A strobe apparatus comprising the flashtube of claim 1.

* * * * *